US005131586A

United States Patent [19]

Capy

[11] Patent Number: 5,131,586

[45] Date of Patent: Jul. 21, 1992

[54] PLEATED PACKAGING WRAPPER AND METHOD OF WRAPPING OBJECTS USING THE SAME

[75] Inventor: Gilbert Capy, Jarnioux, France

[73] Assignee: Akiva Buchberg, Paris, France

[21] Appl. No.: 702,265

[22] Filed: May 17, 1991

Related U.S. Application Data

[63] Continuation-in-part of Ser. No. 687,381, Apr. 18, 1991, and Ser. No. 687,384, Apr. 18, 1991.

[51] Int. Cl.[5] ..... B65D 65/12

[52] U.S. Cl. ..... 229/87.03; 229/87.08; 229/DIG. 3

[58] Field of Search ..... 229/87.03, 87.08, 90, 229/DIG. 3

[56] References Cited

U.S. PATENT DOCUMENTS

| | | | |
|---|---|---|---|
| 1,846,949 | 2/1932 | Clark | 229/87.03 X |
| 1,948,615 | 2/1934 | Clark | 229/87.03 X |
| 2,135,236 | 11/1938 | Koppelman | 229/90 |
| 2,382,400 | 8/1945 | Decker et al. | 229/87.03 |
| 3,016,131 | 1/1962 | Kennedy | 229/DIG. 3 X |
| 3,069,067 | 12/1962 | Crane | 229/DIG. 3 X |
| 4,795,648 | 1/1989 | Capy et al. | 229/87.03 X |

FOREIGN PATENT DOCUMENTS

| | | | |
|---|---|---|---|
| 2033605 | 7/1970 | Fed. Rep. of Germany | 229/DIG. 3 |
| 332784 | 11/1903 | France | 229/90 |

*Primary Examiner*—Stephen Marcus
*Assistant Examiner*—Jes F. Pascua
*Attorney, Agent, or Firm*—Kane, Dalsimer, Sullivan, Kurucz, Levy, Eisele and Richard

[57] ABSTRACT

A packaging for wrapping objects, such as hamburgers, tacos and other foodstuff includes a pleated zone which expands when pulled longitudinally, and an unpleated, or straight zone which is used originally to wrap the object. The packaging is easier to use than packaging having only a pleated zone.

16 Claims, 6 Drawing Sheets

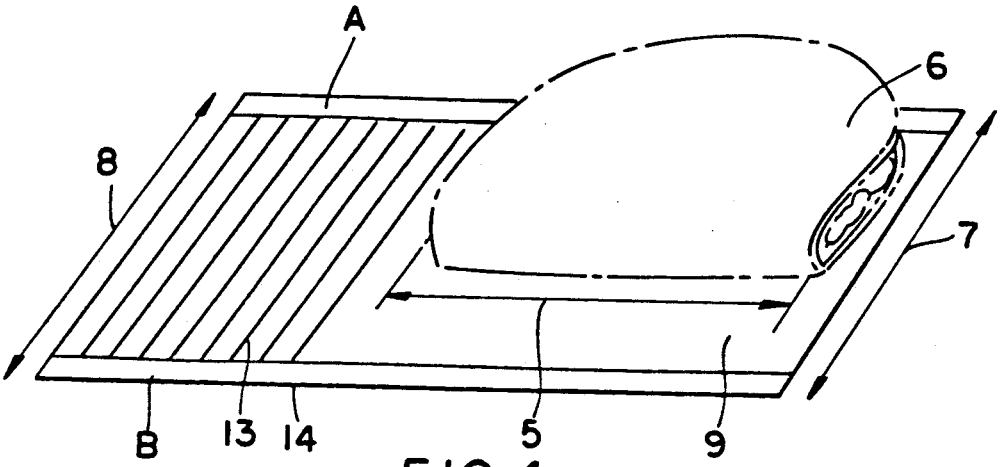
FIG. 4
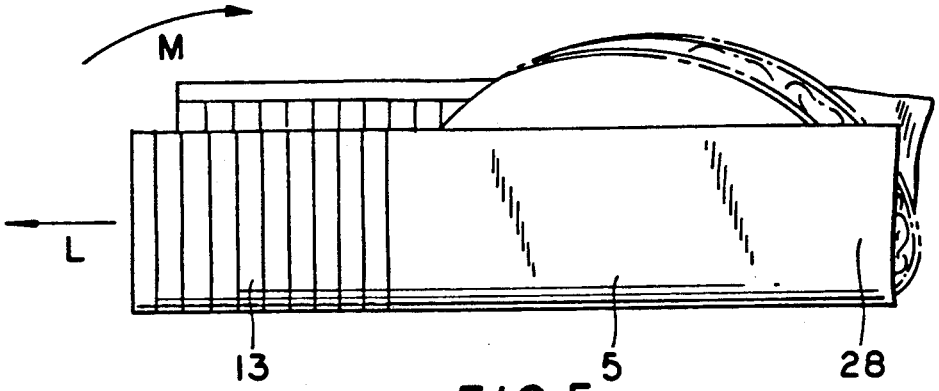
FIG. 5
FIG. 6
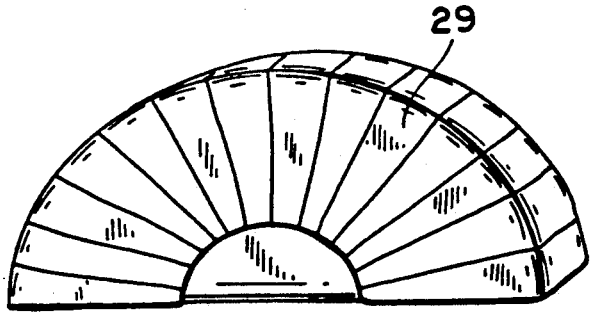

PLEATED PACKAGING WRAPPER AND METHOD OF WRAPPING OBJECTS USING THE SAME

RELATED APPLICATIONS

This is a continuation in part to application Ser. No. 687,381 filed Apr. 18, 1991, entitled PLEATED PACKAGING WRAPPER FOR OBJECTS; and application Ser. No. 687,384 filed Apr. 18, 1991, by the present inventors, and entitled CONTINUOUS SHEET PLEATING DEVICE FOR MAKING OVERLAPPING PLEATS AND ARRANGEMENTS FOR MAKING AREAS WITH NO PLEATS AND METHODS OF MAKING PLEATS.

BACKGROUND OF THE INVENTION

A. Field of Invention

This invention pertains to a pleated packaging useful for wrapping various objects, such as sandwiches, or other foodstuff, and method of using the same.

B. Description of the Prior Art

In U.S. Pat. No. 4,795,648, incorporated herein by reference, there is described a packaging made from a thin sheet which is pleated and the borders of its pleats are affixed to one another by various methods. The pleats are knife pleats. The dimensions of the pleats are selected to conform to the nature of the object to be packaged and with the distance between the welds. The pleats are fixed at the ends, and are free at the middle, such that when they are opened up they form a hollow shape which is suitable for wrapping round sandwiches and the like. The patent describes a method enabling this type of shape to be obtained from a flat sheet by making parallel knife pleats which give the folded wrapping a substantially planar configuration that is bulked up by unfolding.

In co-pending application Ser. No. 687,381 filed Apr. 18, 1991, entitled PLEATED PACKAGING WRAPPER FOR OBJECTS, a more generalized structure is described for pleated packaging. However, when the packaging constructed as described above was tested, it was found there was some difficulty in using the packaging to wrap certain objects especially if the objects were fragile such as, for example, sandwiches. Thus wrapping fragile objects required more training, and was time consuming.

Moreover, it was found that certain wrapping such as for hamburgers require reinforcement to protect the hamburger against crushing and to resist vertical forces.

OBJECTIVES AND SUMMARY OF THE INVENTION

It is an objective of the present invention to provide a pleated packaging which is easier to use.

A further objective is to provide a pleated packaging which can be used to wrap fragile objects such as sandwiches, tacos and other food stuff.

Yet a further objective is to provide a packaging which provides support and protection to the wrapped object so that the object is not damaged while it is being carried.

Other objectives and advantages of the invention shall become apparent from the following description.

A packaging constructed in accordance with this invention includes a pleated zone consisting of a series of parallel pleats with a central region, and a straight zone dimensioned to fit at least partially around the object. The object is first placed on the straight zone, after which the pleated zone is expanded and trained around the object to complete the packaging. The straight zone may be made of a stiff material such as cardboard to protect the object. The packaging of different shapes and sized may be made to fit around hamburgers, tacos, etc.

BRIEF DESCRIPTION OF THE DRAWINGS

FIG. 4 shows another embodiment of the invention for wrapping a flat semi-circular object;

FIG. 5 shows the packaging of FIG. 4 partially enveloping the object being wrapped;

FIG. 6 shows the object of FIG. 5 completely wrapped;

DETAILED DESCRIPTION OF THE INVENTION

Figure 1:
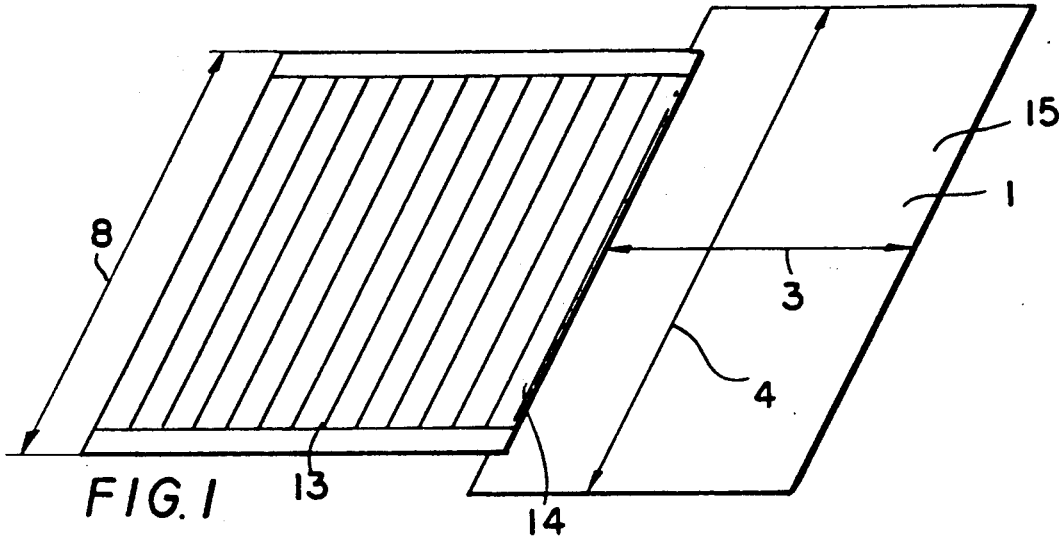
FIG. 1 shows a perspective view of a first embodiment of the invention.

Referring now to FIG. 1, a packaging constructed in accordance with this invention is generally a flat relatively thin sheet composed of two zones 1 and 13. Zone 13 is generally rectangular and is formed by taking a sheet of paper, or other material, and folding it to form sequential pleats. Zone 13 has a width 8 which in this embodiment is smaller than the dimension 4 of zone 1. Zone 1 is unpleated, or straight and is joined adhesively or by other means to zone 13.

In a preferred embodiment of the invention, the packaging consists of a layer of paper coated with a plastic material such as polyethylene. Thus, zone 1 includes an upper layer or face 15 of polyethylene and lower layer or face 30 of paper.

In the embodiment of FIG. 1, zone 1 is attached by using an adhesive, or any other similar means, to the border section 14 of zone 13, wherein the polyethylene layer 15 of zone 1 contacts the paper layer 16 of zone 13.

Figure 2:
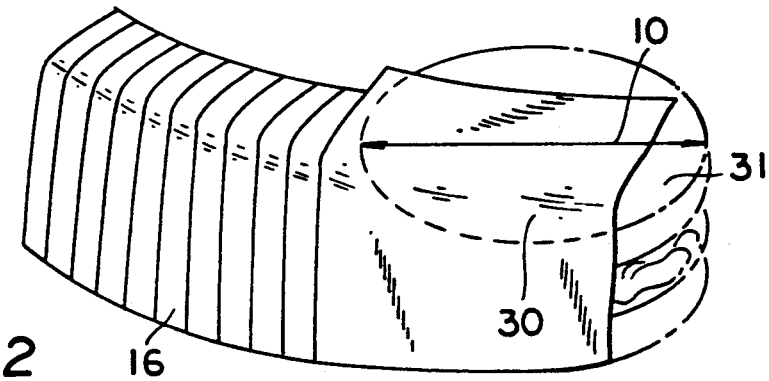
FIG. 2 shows a round sandwich being wrapped using the packaging of FIG. 1.

The dimensions 3 and 4 of zone 1 are selected so that zone can at least partially cover the object to be wrapped. For example, FIG. 2 shows a generally cylindrical object which may be sandwich such as a hamburger 31, having a generally round top with a diameter 10. Hamburger 31 is wrapped by first positioning the packaging so that zone 1 is disposed peripherally around the hamburger 31 with the polyethylene layer contacting the hamburger. The zone 1 is then folded over the hamburger top 31 and bottom (not shown). The wrapping is completed by pulling on the zone 13 longitudinally so that the pleats open at their central region disposed adjacent to the side of the hamburger and training zone 13 around the hamburger until the hamburger is totally enclosed. The closed regions of the pleat form the top 12 of the wrapping, except for circular opening 11. At opening 11, the hamburger may be covered by the edges of zone 1.

It was found that the packaging shown in FIG. 1 can be used easier and faster then a packaging formed of a completely pleated material. Moreover it is easier for the customer to hold the hamburger using the straight, unpleated zone 1.

The embodiment of FIG. 4 is similar to the previous embodiment but it is made up of a single sheet composed of a pleated zone 13 and a straight zone 9. In this embodiment, the two zones 9, 13 have widths 7, 8 respectively which are substantially the same. As discussed in U.S. Pat. No. 4,795,648, a pleated packaging is made from a sheet folded to make pleats 13. The pleats are secured by two fixation bands, A and B or other securing means. Advantageously, the embodiment of FIG. 4 can be made by first making a pleated sheet and then opening the pleats before fixation bands A, B are applied. Alternatively, the packaging may be made from a single sheet by not forming the pleats in zone 9 at all. The packaging of FIG. 4 may have, for example, an overall length and width in the range of 5.86"-6.25". The pleated zone 13 may consist of about 10-12 pleats, each pleat being formed by two sheet folds having a width of 0.58" and 0.39" respectively.

The embodiment of FIG. 4 is particularly suited for wrapping relatively flat, semicircular objects, such as a taco. As shown in FIG. 4, a taco 6 is first placed on the top half of zone 9. Zone 9 is formed so that its length exceeds the length 5 of the taco 6. The whole packaging is then folded over to partially cover the taco, as seen in FIG. 5. Preferably the width 7,8 of the packaging is smaller than the width of the taco. In the configuration of FIG. 5, a portion of the taco thus extends above the packaging. The taco is then finally wrapped by pulling longitudinally on zone 13 as indicated in FIG. 5 by arrow L and then training zone 13 around the taco 6 and zone 9 as indicated by arrow M. The final closed wrapping is shown in FIG. 6.

Figure 3:
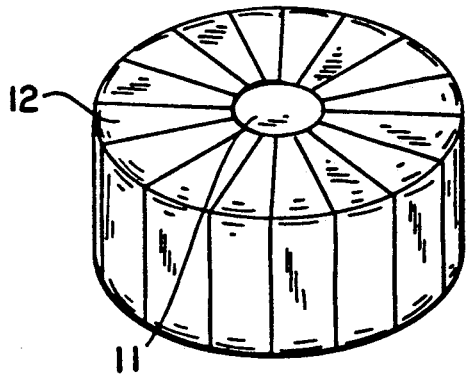
FIG. 3 shows the sandwich of FIG. 2 completely wrapped.

The packaging of FIGS. 4-6 has the same advantages as the wrapping of FIGS. 1-3, except that it is more suitable for tacos. More specifically, a customer can easily remove the zone 13 and use the remaining zone 9 to hold the taco during eating.

Figure 7:
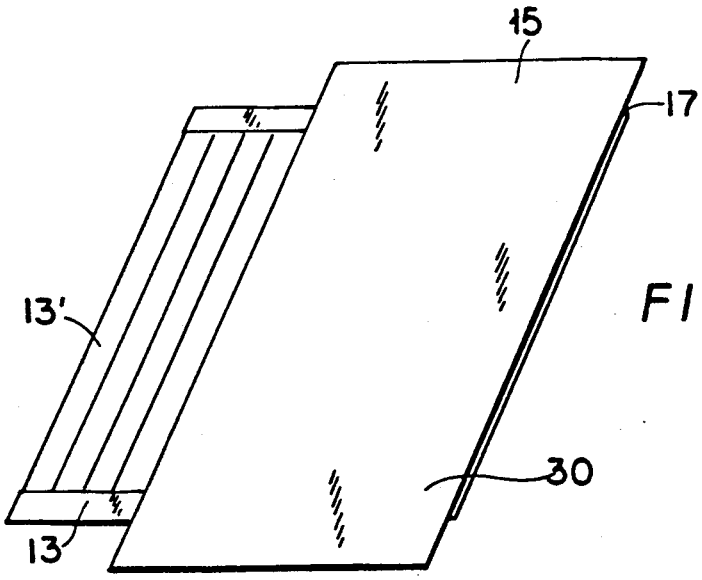
FIG. 7 shows a third embodiment of the invention, in an overlapped configuration.
Figure 8:
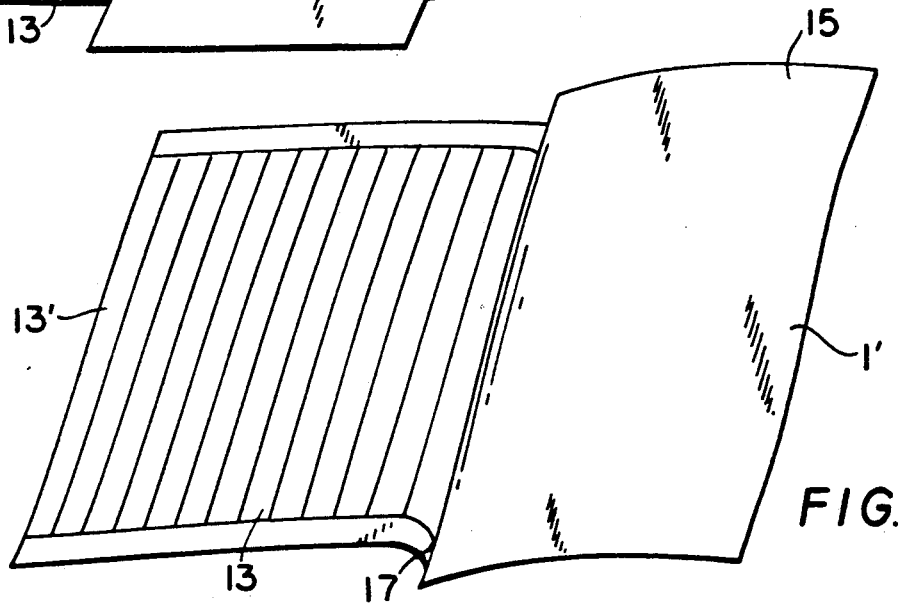
FIG. 8 shows the embodiment of FIG. 7 in the open configuration.

In the embodiment of FIGS. 7 and 8, zones 13, 1' are adhesively secured along border 17 with the polyethylene layer 15 facing the polyethylene layer 13' of zone 13. Before an object is wrapped in this packaging, the two zones are unfolded as shown in FIG. 8. The object is then placed on zone 1' and zone 13 is then wrapped around the object as in the previous embodiment.

Figure 9:
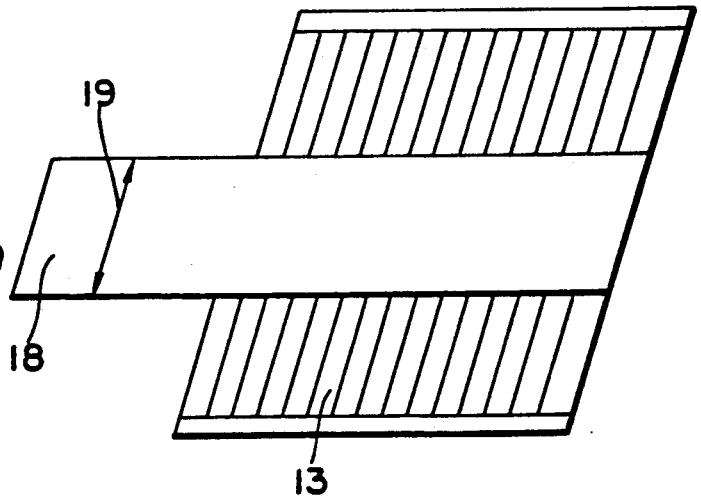
FIG. 9 shows a fourth embodiment of the invention with a semi-rigid reinforcement band.
Figure 10:
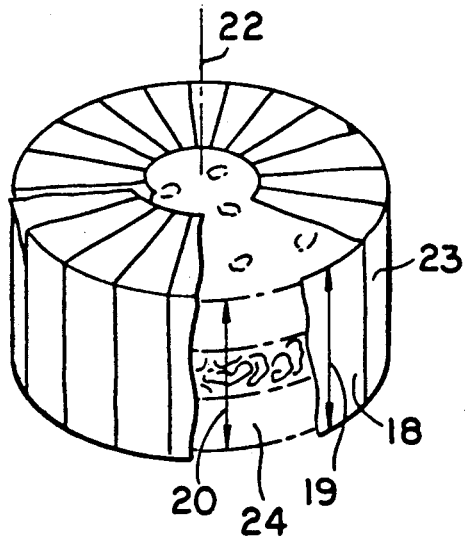
FIG. 10 shows an isometric partial sectional view of a sandwich wrapped in the packaging of FIG. 9.

The embodiment of FIGS. 9 and 10 is composed of a pleated zone 13 and a straight, unpleated zone 18 which may be secured to zone 13 in a manner similar to zone 15 in FIGS. 7, 8. While pleated zone 13 is made of a relatively thin film which is easily pleated, zone 18 is made of stiffer material, such as cardboard coated with a plastic material. The width 19 of zone 18 is selected to correspond to the height of the object to be wrapped. Moreover, while zone 13 expands in its central region in length while it is being opened, the length of zone 18 remains the same. Thus prior to wrapping, the zone 18 is longer than zone 13. As shown in FIG. 10, the packaging of FIG. 9 is wrapped around a hamburger 24 so that zone 18 is disposed peripherally around the side of the hamburger. In this manner zone 18 forms a protective wall within the wrapping for the hamburger to protect it from vertical forces.

Figure 11:
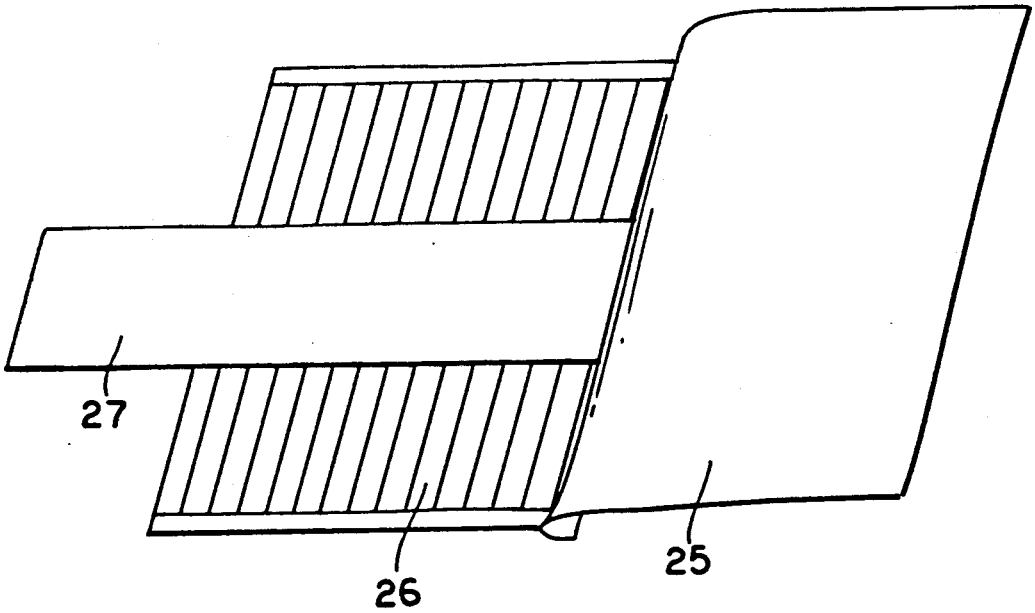
FIG. 11 shows an alternate embodiment of the invention combing the features of the embodiments of FIGS. 8 and 9.

The various embodiments of the invention may be combined. For example, in FIG. 11 the composite packaging consists of a pleated zone 26 similar to zone 13 in the previous embodiments, a first straight or unpleated zone 25 similar to zone 15 in FIG. 8, and a second straight, unpleated zone 27 similar to zone 18 in FIG. 9.

Importantly, the packaging described herein requires less paper. For example, the embodiment of FIG. 1 requires 25% less paper than a fully pleated packaging. Moreover, this configuration further results in substantial savings in manufacturing since pleating of the straight zone is not required.

Figure 12:
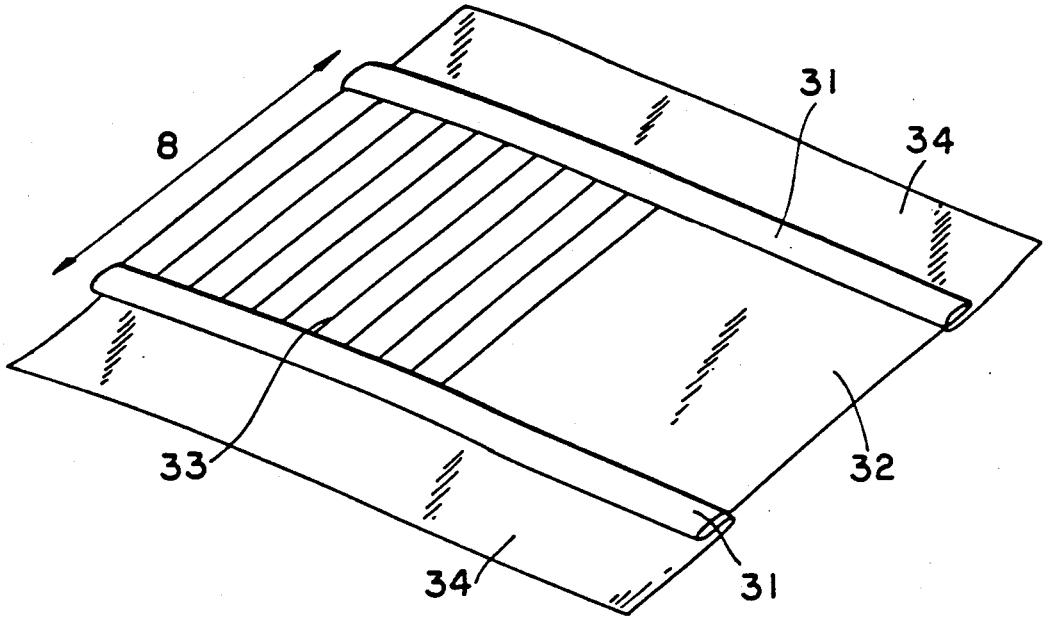
FIG. 12 shows a further embodiment of the invention.

FIG. 12 shows yet another embodiment of the invention wherein a wrapper is formed of a zone 32 without pleats and a zone 33 with pleats, said two zones 32, 33 having the same width 8. The pleats of zone 33 are fixed by fixation bands 31 made, for example, of paper. The bands are glued, or affixed by other similar means to both the first and the back faces of the pleated and the unpleated zones. Preferably, the bands 31 are folded back to form longitudinal unpleated zones 34. The edges of the pleats, which may be sharp, are thus protected by bands 31. This embodiment is easy to manufacture in a continuous strip, using for example, the apparatus of application Ser. No. 07/687,384.

Figure 13:
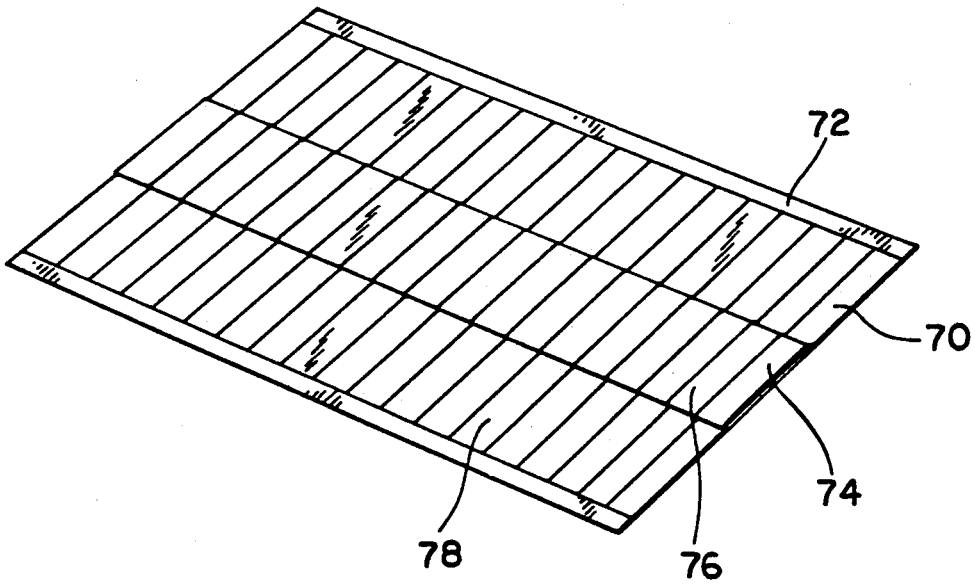
FIG. 13 shows yet another embodiment of the invention.

As another embodiment of the invention in FIG. 13, a double wrapping is shown including a pleated sheet 70 with fixation bands 72 and a strip 74 disposed in the central region of sheet 70. Strip 74 may consist, for example, of a band of paper coated on the top surface 76 with aluminum foil. Preferably, the strip 74 is secured to a straight sheet and then both sheets are pleated simultaneously. For example, if the top surface 78 of sheet 70 and the bottom surface of strip 74 are plastic coated then the two components can be easily welded by application of heat.

The strip 74 makes the wrapping resistant to stains, for example from sauces if the wrapping is used for a hamburger. Moreover, the strip also acts as a thermal barrier to maintain the central region of the wrapped article warm. Usually this central region of the wrapped article is warmer than its top or bottom. If strip 74 is made slightly thicker than sheet 70, it reinforces the sheet 70 against creasing and protect the wrapped article in the vertical or transversal direction. An advantage of this latter embodiment is that when the double wrapping is discarded it does not create more voluminous refuse than a single-ply wrapping.

Figure 14:
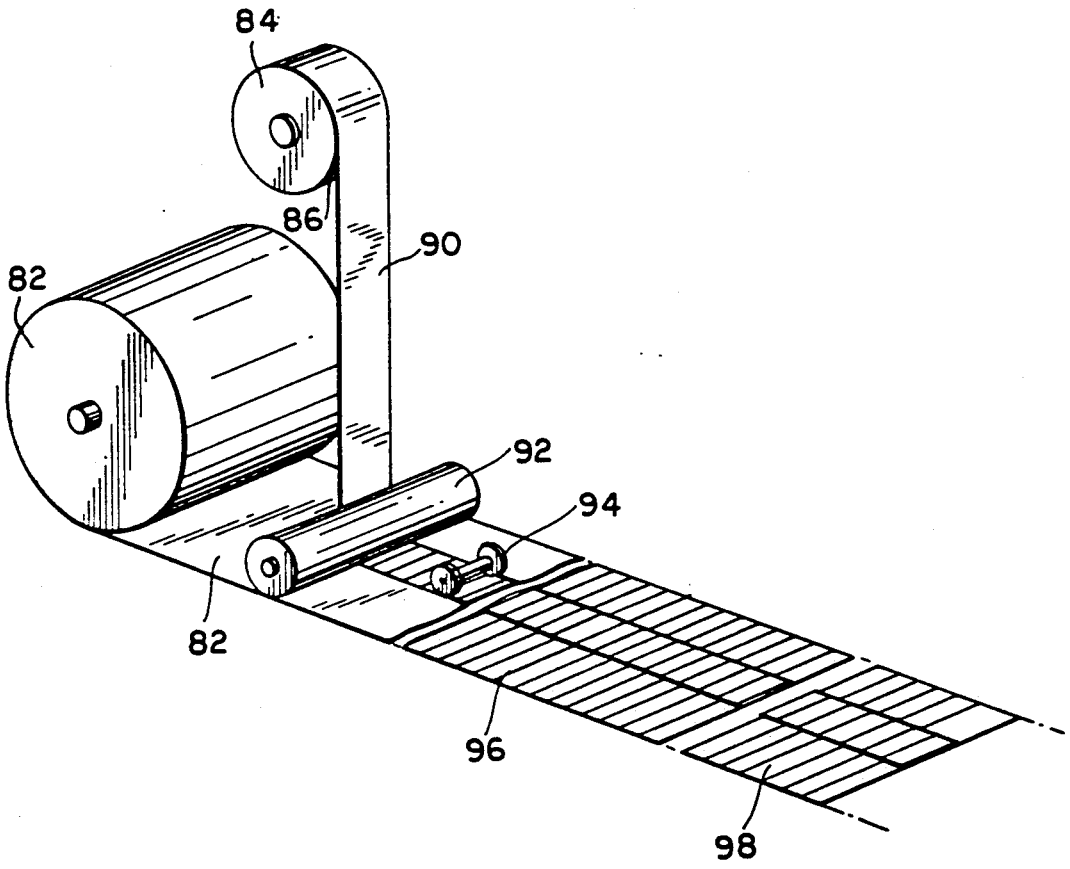
FIG. 14 shows schematically how the embodiment of FIG. 13 is formed.

As shown in FIG. 14, the double wrapping may be formed by providing a first roll of paper 80 having a top surface 82 coated with polyethylene, and a second roll of paper 84 coated on the bottom surface with polyethylene, and coated on top surface 88 with aluminum foil. The two strips from the two rolls are positioned in contact with each other by a pressure roller 92 and then welded together by using a sealing roller 94. Thereafter the joined strips are pleated to result in a pleated product 96. Product 96 is then cut to size as at 98.

In the Figures all the pleated regions zones are shown as being formed of parallel, symmetrical pleats. Of course, it should be understood that other types of pleats may be used as described in my copending application Ser. No. 07/687,381.

It should be understood that in all these embodiments due to the semi-rigid nature of the material of the packaging, once the pleated zone I is fully extended by opening the central portions of the pleats, as shown in FIGS. 3, 6 and 10, the pleated zone 1 retains its extended shape.

Numerous modifications may be made to this invention without departing from its scope as defined in the appended claims.

I claim:

1. A packaging for wrapping an object, said packaging comprising:

a first zone consisting of a pleated sheet having lateral edges and first and second sides, said sheet being folded into successive pleats between said lateral edges, and first and second fixation areas disposed along said sides for fixing said pleats, wherein said first zone may be applied by training said lateral edges at least partially around said object to open said pleats with said first and second sides forming end openings; and a second zone consisting of a straight sheet and attached on one side to one of said lateral edges of said first zone with said second zone being disposed adjacent to said object when said first zone is applied to said object.

2. The packaging of claim 1 wherein said first zone and second zone are joined end-to-end to form a continuous package sheet.

3. The packaging of claim 1 wherein said second zone is folded over said first zone.

4. The packaging of claim 1 wherein said first and second zones are formed from a continuous paper film.

5. The packaging of claim 1 wherein said first and second are made of the same material.

6. The packaging of claim 1 wherein said first zone is of a relatively thin material and said second zone is made a material stiffer than the material of said first zone.

7. The packaging of claim 1 wherein said first zone is than said second zone.

8. The packaging of claim 1 wherein said first zone is narrower than said second zone.

9. The packaging of claim 1 further comprising a third zone, said third zone being made of a stiffer material than said first and second zone, wherein said third zone is disposed peripherally around said object for protection when said packaging is wrapped around said object.

10. The packing of claim 1 where at least one of said zones consists of a layer of paper covered by a layer of plastic.

11. The packaging of claim 1 wherein said pleats are parallel.

12. A packaging for wrapping an object having a height, said packaging comprising:

a first member consisting of a pleated sheet having lateral edges and first and second sides, said sheet being folded into successive pleats between said lateral edges, and first and second fixation areas disposed along said sides for fixing said pleats, wherein said first member may be applied by training said lateral edges at least partially around said object to open said pleats with said first and second sides forming end openings; and a second member consisting of a straight sheet with a width substantially equal to said height of said object and attached on one side to one of said lateral edges of said first member, said second member being arranged to protect said object when said second member is trained around said object.

13. The packaging of claim 12 wherein said second member is made of a material stiffer than the material of said first member.

14. The packaging of claim 12 wherein said second member has a length selected to enclose said object.

15. A packaging for wrapping an object, said packaging comprising:

a first member consisting of a pleated sheet having lateral edges and first and second sides, said sheet being folded into successive pleats between said lateral edges, and first and second fixation areas disposed along said sides for fixing said pleats, wherein said first member may be applied by training said lateral edges at least partially around said object to open said pleats with said first and second sides forming end openings; and a second member consisting of a straight sheet and attached on one side to one of said lateral edges of said first member and extending beyond one of said first and second sides, said second member being arranged to close one of said end openings as said first member is applied to said object.

16. A method of packaging an object, such as foodstuff, comprising the steps of:

providing a packaging including a straight zone connected to a pleated zone, said pleated zone being formed of a sheet having lateral edges and first and second sides, said sheet being folded into successive pleats between said lateral edges, and first and second fixation areas disposed along said sides for fixing said pleats;

placing said object on said straight zone;

wrapping said object at least partially with said straight zone; and wrapping said object with said pleated zone by training said sheet around said object and partially opening said pleats.

* * * * *